US005107168A

United States Patent [19]

Friedrich et al.

[11] Patent Number: 5,107,168

[45] Date of Patent: Apr. 21, 1992

[54] SPARK PLUG WITH CENTRAL ELECTRODE ATTACHMENT MEMBER CONTAINING PLATINUM OR PLATINUM ALLOY

[75] Inventors: Gruber Friedrich, Hippach; Auer Reinhart, Brandenberg; Kranabetter Georg, Jenbach, all of Austria

[73] Assignee: Jenbacher Werke Aktiengesellschaft, Jenbach, Austria

[21] Appl. No.: 742,225

[22] Filed: Aug. 6, 1991

Related U.S. Application Data

[63] Continuation of Ser. No. 481,898, Feb. 20, 1990, abandoned.

[30] Foreign Application Priority Data

Feb. 21, 1989 [DE] Fed. Rep. of Germany ..... 8902032

[51] Int. Cl.[5] ..... H01T 13/20; H01T 13/32; H01T 13/46

[52] U.S. Cl. ..... 313/140; 313/141

[58] Field of Search ..... 313/140, 141

[56] References Cited

U.S. PATENT DOCUMENTS

| | | | |
|---|---|---|---|
| 892,285 | 6/1908 | Moonen et al. | 313/140 X |
| 2,314,128 | 3/1943 | Coldwell | 313/140 |
| 2,318,922 | 11/1943 | Carington | 313/141 X |
| 2,391,456 | 12/1945 | Hensel | 313/141 X |
| 2,640,474 | 6/1953 | Phillips | 313/140 |
| 3,548,239 | 12/1970 | Eaton | 313/141 X |
| 4,122,366 | 10/1978 | von Stutterheim | 313/141 |
| 4,700,103 | 10/1987 | Yamaguchi et al. | 313/141 |

FOREIGN PATENT DOCUMENTS

| | | | |
|---|---|---|---|
| 1941979 | 12/1980 | Fed. Rep. of Germany . | |
| 3132814 | 4/1982 | Fed. Rep. of Germany . | |
| 3730627 | 3/1988 | Fed. Rep. of Germany . | |
| 855140 | 5/1940 | France | 313/140 |
| 239420 | 9/1925 | United Kingdom | 313/141 |
| 578430 | 6/1946 | United Kingdom | 313/140 |

*Primary Examiner*—Palmer C. DeMeo
*Attorney, Agent, or Firm*—Lorusso & Loud

[57] ABSTRACT

A sparking plug with a central electrode insulated in respect of the plug screw-thread and with earth electrodes which are electrically connected to the plug screw-thread, there being at the combustion chamber end of the central electrode an attachment part which consists at least partially of platinum or a platinum alloy, the spark gaps being disposed between it and the earth electrodes which extend to it from the side. According to the invention, the attachment part takes the form of a prism, the top surface of which faces the combustion chamber. Furthermore, the earth electrodes extend laterally alongside the side faces of the substantially prismatic attachment member parallel with the edges of top or base surfaces of the prism. This ensures considerable stability and low burn-off. Furthermore, the electrode gap can easily be adjusted.

8 Claims, 3 Drawing Sheets

SPARK PLUG WITH CENTRAL ELECTRODE ATTACHMENT MEMBER CONTAINING PLATINUM OR PLATINUM ALLOY

BACKGROUND OF THE INVENTION

This is a continuation of copending application Ser. No. 07/481,898 filed on Feb. 20, 1990, and now abandoned.

The invention relates to a central electrode which is insulated in respect of the plug screw-thread and with earth electrodes electrically connected to the plug screw-thread, there being at the combustion chamber end of the central electrode an at least partially platinum or platinum alloy attachment member, the spark gaps being disposed between it and the earth electrodes which extend to it from the side.

In order to be able to operate a sparking plug on lower firing voltages, it is ideal if the electrode surfaces between which the sparks are to jump are relatively small and pointed (high localised field strength). On the other hand, however, it is expected that a sparking plug should also have considerable strength (minimal electrode burn-off), so that small electrode surfaces are rather unfavourable. In order to have both low firing voltages and also a long effective life, there has already been a trend towards higher-grade electrode materials which already exhibit a negligible electrode burn-off.

A prior art sparking plug has a central electrode consisting of copper (for improved heat dissipation), encased by a nickel shell. This sparking plug is relatively competitive in price. It has, however, been found that despite the nickel casing, the effective life such as is required, for example, with stationary gas engines, is too low. Platinum or platinum alloys have proved to be a material with a higher resistance to burn-off. However, since platinum is very expensive, a thin wire-like central electrode of platinum has already been provided. A disadvantage with this is the low mechanical stability of the central electrode, the poor heat dissipation through the platinum wire and the difficulty of conveying a plurality of earth electrodes, as would otherwise be favourable, to the thin platinum wire. Furthermore, the thin platinum wire has virtually no burn-off reserves. It is already known to dispose on the central electrode of a sparking plug an attachment member of platinum or platinum alloys which has the form of a cylinder and on which there are two straight earth electrodes which are connected to it from the side. Where this sparking plug is concerned, there is indeed good mixture admissibility access to the spark gap but there the burn-off on the portions of the cylinder shell which point to the earth electrodes is high despite the use of platinum, so that the attachment point loses its cylindrical shape and alters the electrode gap, among other things. By virtue of the altered shape of the attachment part, it is then very difficult to adjust a clearly defined electrode gap which is needed for optimum engine performance.

SUMMARY OF THE INVENTION

The object of the invention is to provide a competitively priced sparking plug of the type mentioned at the outset but which offers a very high level of strength, particularly a low rate of burn-off of the electrodes while still being capable of operation with relatively low sparking voltages. If necessary, a convenient readjustment facility with a defined electrode gap should be available.

According to the invention, this is achieved in that the attachment part is substantially in the form of a prism, the top surface of which faces the combustion chamber and in that the earth electrodes extend laterally alongside the side faces of the substantially prismatic attachment member and substantially parallel with the edges of the top surface or base surface of the prism.

In the case of sparking plugs, the aim is to attain high local field strengths between the central electrode and the earth electrodes in order to require the lowest possible ignition voltage. Such high field strengths can be achieved by constructing pointed electrodes. But then a disadvantage is that these electrodes burn off fairly quickly. A possible improvement resides in the use of suitable materials, for example platinum or a platinum alloy. With previous electrode geometries, however, even these have failed to produce satisfactory results. In the case of the electrode geometry according to the invention, in which the attachment part has substantially the outer shape of a prism on the central electrode which is of platinum or a platinum alloy, the sharp edges of the prism provide a high local field strength and thus a lowering of the ignition voltage. At the same time, burn-off remains within limits due to the relatively long effective overall length of the prism edges. The spark gaps are thereby between the attachment part and the earth electrodes which extend laterally alongside the attachment part substantially parallel with the prism edges of the top surface or bottom surface, in other words they surround virtually the entire prism-shaped attachment part. By guiding the earth electrodes parallel with the lateral surfaces of the prism-shaped attachment part of platinum, the electrode burn-off, which is in any case only minimal, is also relatively even so that if necessary it is possible easily to carry out a readjustment with a properly defined electrode gap.

In the case of the attachment part which is constructed according to the innovation, what is important about the central electrode, having regard to the sparking and burn-off properties, is essentially the outer shape, particularly the long prism edges, while the base surface generally contributes at least to connecting the attachment part to the central electrode. In order to minimise burn-off, it is essential that the areas of the prismatic attachment part which are on the spark gap should consist of platinum or a platinum alloy, whereas in the middle part it is possible, for example, to use a rod of hard solder in order to connect the attachment part to the central electrode. Such a version makes it possible rigidly to connect the attachment part to the central electrode and also to save on expensive platinum material.

According to a preferred embodiment, the attachment part takes the form of a right prism with square base and top surfaces. With this embodiment, it is possible to use earth electrode rods of preferably quadratic cross-section, angled over at a right-angle, one arm extending parallel with a side face of the attachment part while the other arm extends parallel with the adjacent side face of the attachment part. Thus, one earth electrode is able to cope with two side faces of the attachment part, particularly high field strengths occurring between the top edges of the prism and the inner angle of the angled-over earth electrode.

BRIEF DESCRIPTION OF THE DRAWINGS

The invention will be explained in greater detail hereinafter with reference to examples of embodiment shown in the accompanying drawings, in which.

DETAILED DESCRIPTION OF THE PREFERRED EMBODIMENT

Figure 1:
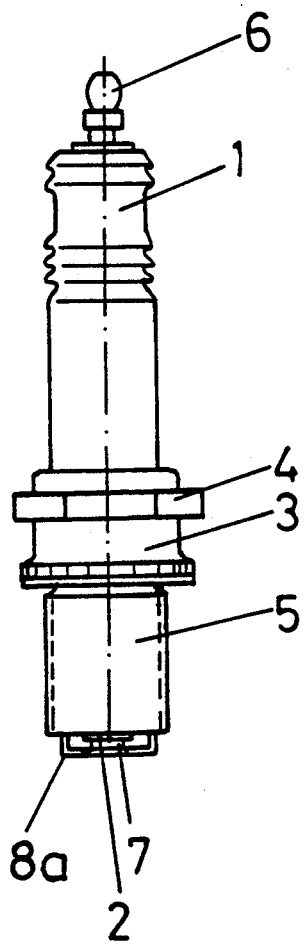
FIG. 1 is a side view of an example of embodiment of sparking plug according to the invention.

The sparking plug shown in FIG. 1 comprises an insulating member 1 for insulating the central electrode 2 in relation to the metal housing 3 which is earthed during operation and which is constructed in one piece with a hexagonal nut 4 and a screw-thread 5. Provided at the top is a conventional connection rod for the central electrode 2. In order to explain the parts which are essential to the invention, reference will now be made to FIGS. 2 and 3.

According to the present invention, the attachment part which in the present embodiment consists of a small platinum plate 7 into which a hard solder rod 7*a* is inserted, is in the shape of a prism, the top surface of which faces the combustion chamber. In the case of the example of embodiment shown in FIGS. 2 and 3, a right prism is used which has square top and bottom surfaces so that it is, in other words, a right parallelepiped. Furthermore, for the sparking plug according to the innovation, it is essential that the earth electrodes 8*a*, 8*b* and 9*a*, 9*b* should extend laterally alongside the side faces of the prismatic attachment part 7 substantially parallel with the prism edges 10 of the top surface. The sharply edged construction of the prism edges 10 at the top surface of the attachment 7 of platinum or platinum alloy produces high local field strengths between this attachment part 7, the central electrode 2 and the earth electrodes 8*a*, 8*b* and 9*a*, 9*b*. At the same time, the great length of the edges keeps the burn-off within limits. In any event, the electrode gap is relatively even over the length of the edges so that a later readjustment to a properly defined electrode gap is readily possible.

Figure 3:
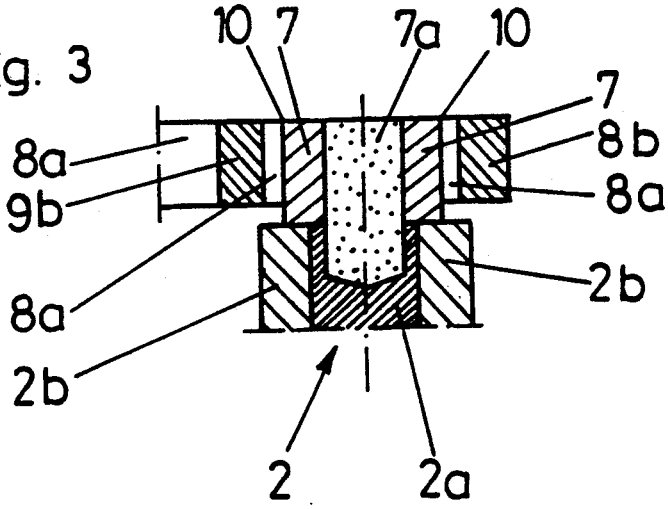
FIG. 3 is a central longitudinal section through the sparking plug, taken on the line A—A in FIG. 2.

With regard to the position of the prismatic attachment part 7, an attitude in which the top surface of the attachment part 7 is at right-angles to the longitudinal axis of the central electrode 2 has been found to be advantageous. Together with the earth electrodes, this permits of a symmetrical sparking plug construction. In order to ensure a mechanically secure connection between the attachment part 7 of platinum or platinum alloy and the central electrode, it is favourable for the base surface of the attachment part 7 to bear at least partially on the combustion chamber end of the central electrode 2. FIG. 3 shows a particularly preferred type of connection between the attachment part 7 and the earth electrode 2. The platinum attachment part 7, the outside of which is shaped like a prism, is provided in the centre with a bore which is aligned with a bore in the copper core 2*a* of the central electrode. A rod of hard solder 7*a* is inserted into these aligned bores and then fused in by heating. Consequently, a mechanically very robust joint is created between the attachment part 7 of platinum or platinum alloy and the central electrode 2. Furthermore, this type of connection has the advantage of saving on expensive platinum because only relatively cheap hard solder 7*a* has to be provided in the middle of the attachment part, while those areas of the attachment part which are on the spark gap naturally consist of platinum or a platinum alloy in order to ensure minimal burn-off.

On manufacturing grounds and with an eye to having an ideal spark with a well-defined electrode gap, it is favourable for the attachment part 7 to be in the form of a right prism. For reasons of symmetry, the centre of gravity of the top surface of the attachment part 7 will be disposed on the imaginary longitudinal axis through the central electrode 2.

In order to save on platinum on the one hand and still provide adequate angle lengths along which the spark gap can form, on the other, it is a good idea for the diagonal dimensions of the top surface of the attachment part 7 of platinum or platinum alloy to be in the region of the diameter of the central electrode 2. A comparison of the example of embodiment shown in FIG. 3 with that shown in FIG. 4 demonstrates that the example of embodiment shown in FIG. 3 requires somewhat less platinum, while the example of embodiment shown in FIG. 4, in which the base surface of the attachment part 7 consists of platinum and projects somewhat beyond the central electrode, also the longitudinal edges 11 of the base area of the prismatic attachment part 7 are disposed on the spark gap between the attachment part 7 and the earth electrode.

The earth electrode rods expediently have, parallel with the flat side surfaces of the attachment part 7, lateral surfaces which are flat in order to guarantee a well-defined electrode gap. Expediently, the earth electrode rods will in per se known manner be constructed with a rectangular, preferably square cross-section, it being entirely feasible for these earth electrode rods to be provided with platinum or a platinum alloy at least in those areas which face the spark gap.

Figure 4:
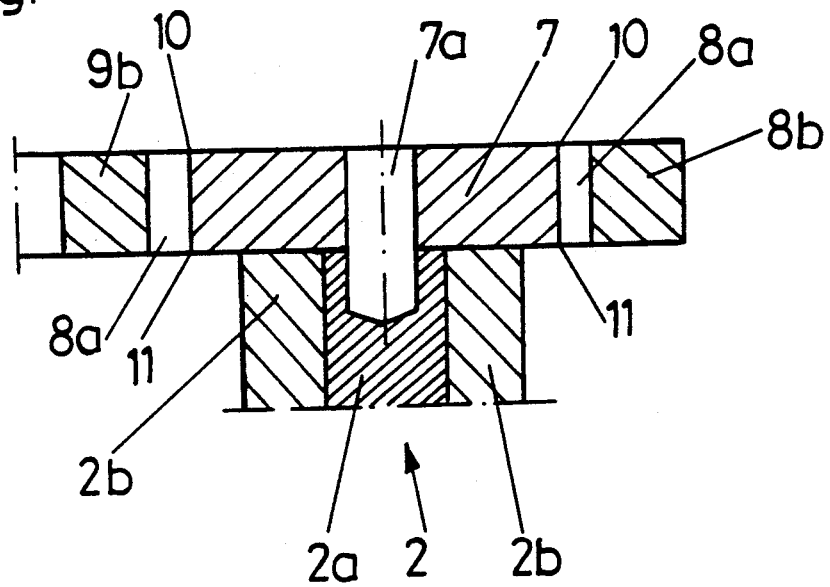
FIG. 4 is a central longitudinal section as in FIG. 3 but through another example of embodiment.

FIGS. 3 and 4 show that the top surfaces of the attachment 7 of platinum or platinum alloy and the surfaces of the earth electrodes 8*a*, 8*b*, and 9*a*, 9*b* which face the combustion chamber lie in one plane. This construction promotes mixture accessibility on the one hand while on the other it makes it possible easily to file down the attachment part and the earth electrodes jointly in order once again to have sharp electrode edges even after prolonged usage.

Figure 2:
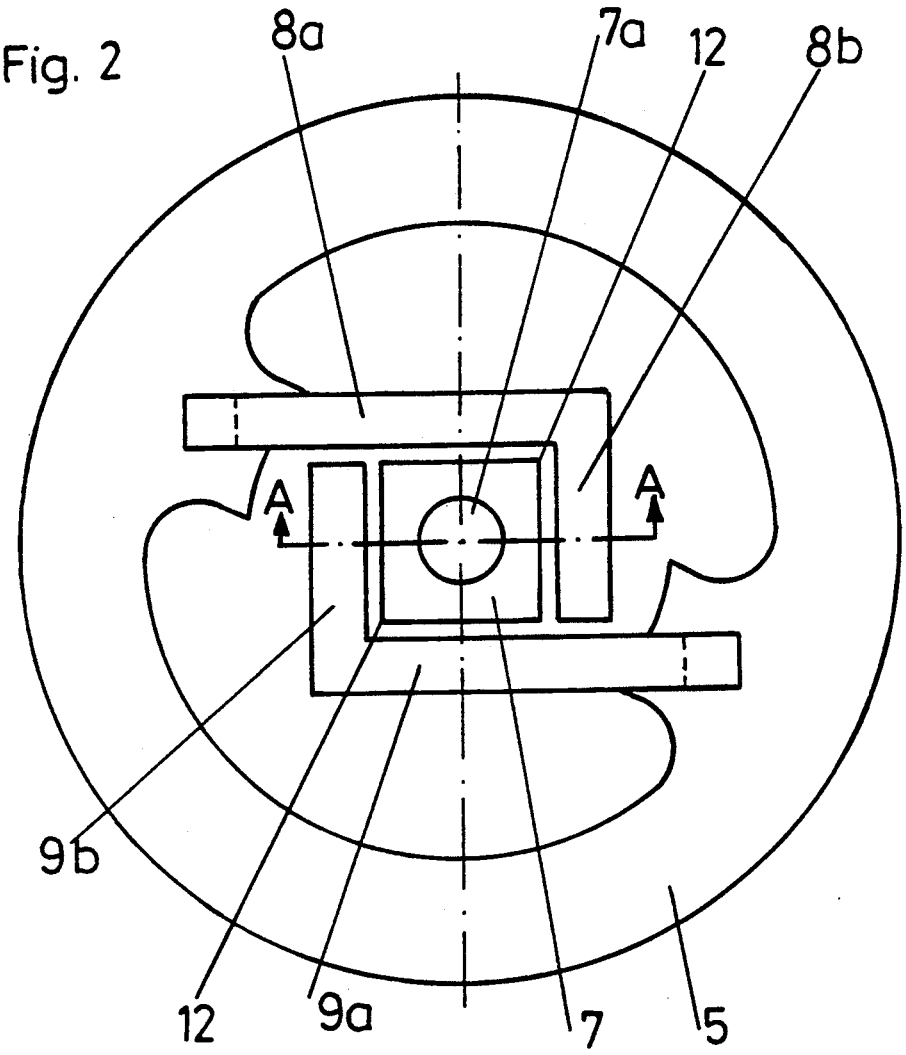
FIG. 2 shows a view of the bottom of the sparking plug, on an enlarged scale and viewed from the combustion chamber.

As especially FIG. 2 shows, the earth electrodes—when the sparking plug is viewed from below—are angled over, one arm 8*a* or 9*a* being in each case parallel with a side face of the attachment part 7 while the other arm 9*b* or 8*b* extends parallel with whichever is the adjacent side face of the attachment part 7. A particular advantage of this embodiment is that high local field strengths occur between the top edges 12 of the prisms and the inside angles of the angled-over earth electrodes and they permit of a further reduction in ignition voltage. Such an embodiment can be produced particularly easily if the prismatic attachment part 7 has a rectangular or square base surface or top surface, as shown in FIG. 2.

Figure 5:
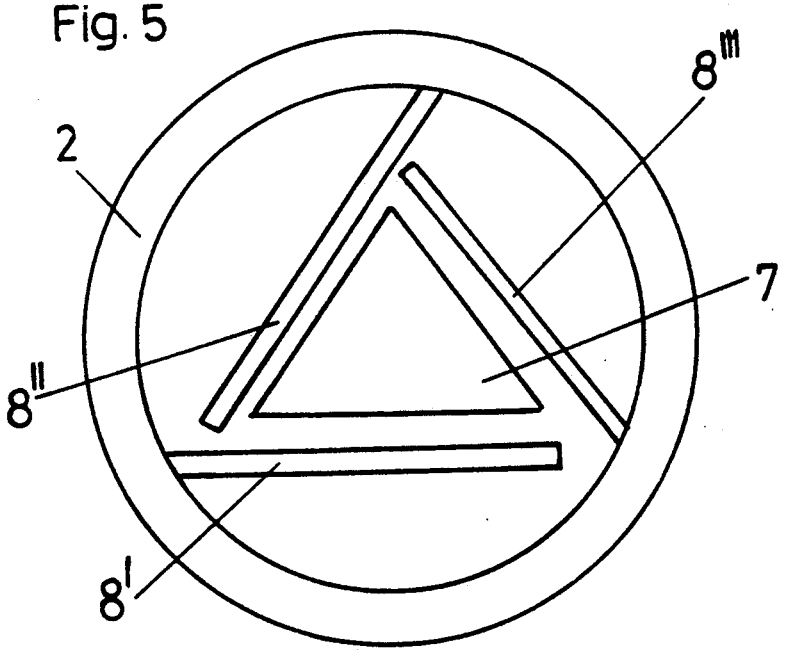
FIG. 5 shows a view of the underside of a third example of embodiment of sparking plug according to the invention and seen from the combustion chamber.

However, also other shapes of top surface are feasible. For example, FIG. 5 shows an attachment part 7 in the form of a right prism with a triangular top surface. With this embodiment, each side of the prism of the attachment part 7 has its own earth electrode 8', 8'' or 8''' associated with it. The connection of the attachment part 7 in the form of a triangular prism as shown in FIG. 5 to the earth electrode 2 can, for example, be achieved by directly connecting the base surface of the attachment part 7 to the end of the central electrode which points to the combustion chamber.

The embodiments of sparking plug according to the innovation which is shown in FIGS. 2 to 4 can be manufactured in accordance with a preferred production method. To this end, a prismatic attachment part consisting of platinum or a platinum alloy is provided with a bore and in the central electrode 2 of the sparking plug there is likewise a central bore. The attachment part 7 is then placed on the central electrode 2 until the bores are aligned and then a rod *7a* of a metal or metal alloy, preferably hard solder, is inserted. Subsequent heating causes this metal rod to be fused and produce a mechanically strong connection between the attachment part 7 and the central electrode 2.

We claim:

1. A sparking plug comprising: a central electrode; a plug screw-thread insulated from said central electrode; and earth electrodes electrically connected to said plug screw-thread; said central electrode having an end, on which is disposed an attachment member consisting at least partially of platinum or a platinum alloy, with spark gaps disposed between said attachment member and said earth electrodes, said earth electrodes extending laterally along side faces of said attachment member; said attachment member being further characterized in that it has the form of a prism, with a top and a base surface, said top surface having diagonal dimensions in the range of a diameter of said central electrode, said top surface facing the combustion chamber of said central electrode, and in that the earth electrodes extend laterally along said side faces of said attachment member and substantially parallel with edges of said top or base surface of said prism.

2. The sparking plug according to claim 1, characterized in that the top surface of the attachment member is at right-angles to the longitudinal axis of the central electrode.

3. The sparking plug according to claim 1, characterized in that the base surface of the attachment member bears at least partially on the combustion chamber end of the central electrode.

4. The sparking plug according to claim 1, characterized in that said attachment member further comprises a central bore which is aligned with a bore in said central electrode, said bores being filled with a fused-in metal or a fused-in metal alloy, particularly hard solder, to connect said attachment member to said central electrode.

5. The sparking plug according to claim 1, characterized in that the base surface of the attachment member is directly connected to the combustion chamber end of the central electrode.

6. The sparking plug according to claim 1, characterized in that the attachment member takes the form of a right prism.

7. The sparking plug according to claim 1, characterized in that the base surface or top surface of the attachment member is rectangular, and is preferably square.

8. The sparking plug according to claim 1, characterized in that the base surface or top surface of the attachment member is triangular.

* * * * *